US006139651A

United States Patent [19]

Bronfin et al.

[11] Patent Number: 6,139,651

[45] Date of Patent: Oct. 31, 2000

[54] MAGNESIUM ALLOY FOR HIGH TEMPERATURE APPLICATIONS

[75] Inventors: Boris Bronfin, Beer-Sheva; Eliyahu Aghion, Omer, both of Israel; Soenke Schumann, Schwuelper, Germany; Peter Bohling, Hannover, Germany; Karl Ulrich Kainer, Clausthal-Zellerfeld, Germany

[73] Assignees: Dead Sea Magnesium Ltd, Beer-Sheva, Israel; Volkswagen AG, Wolfsburg, Germany

[21] Appl. No.: 09/366,834

[22] Filed: Aug. 4, 1999

[30] Foreign Application Priority Data

Aug. 6, 1998 [IL] Israel ..... 125681

[51] Int. Cl.[7] ..... C22C 23/00; C22C 23/02; C22C 23/04

[52] U.S. Cl. ..... 148/420; 420/405; 420/409; 148/538

[58] Field of Search ..... 420/409, 405; 148/420, 538

[56] References Cited

U.S. PATENT DOCUMENTS

| | | | |
|---|---|---|---|
| 2,712,564 | 7/1955 | Fry et al. | 136/100 |
| 3,119,725 | 1/1964 | Foerster et al. | 148/11.5 |
| 3,496,035 | 2/1970 | Foerster et al. | 148/32.5 |
| 5,143,564 | 9/1992 | Gruzleski et al. | 148/420 |
| 5,147,603 | 9/1992 | Nussbaum et al. | 420/409 |
| 5,223,215 | 6/1993 | Charbonnier et al. | 420/407 |
| 5,855,697 | 1/1999 | Luo et al. | 148/420 |

FOREIGN PATENT DOCUMENTS

| | | |
|---|---|---|
| 683813 | 12/1952 | United Kingdom . |
| 901324 | 7/1962 | United Kingdom . |

*Primary Examiner*—George Wyszomierski
*Assistant Examiner*—Janelle Combs Morillo
*Attorney, Agent, or Firm*—Baker Botts L.L.P.

[57] ABSTRACT

A magnesium based alloy for high pressure die casting, comprising at least 83 wt % magnesium; 4.5 to 10 wt % Al; wt % Zn that is comprised in one of the two ranges 0.01 to 1 and 5 to 10; 0.15 to 1.0 wt % Mn; 0.05 to 1 wt % of rare earth elements; 0.01 to 0.2 wt % Sr; 0.0005 to 0.0015 wt % Be; and calcium in an amount higher than 0.3 (wt % Al $-4.0)^{0.5}$ wt % and lower than 1.2 wt %. The alloy may further comprise incidental impurities. The alloy may comprise at least 88 wt % magnesium, 4.5 to 10 wt % Al, 0.1 to 1 wt % of rare earth elements. The alloy may contain 5 to 10 wt % Zn and 0.1 to 1 wt % of rare earth elements, and wherein the zinc content is related to the aluminum content by the formula: wt % Zn=8.2–2.2 in (wt % Al –3.5).

13 Claims, 4 Drawing Sheets

Fig. 1. Hypothetic ternary phase diagram Mg-Al-Me

MAGNESIUM ALLOY FOR HIGH TEMPERATURE APPLICATIONS

FIELD OF THE INVENTION

The invention relates to a magnesium alloy. An object of the invention is to create a magnesium alloy for elevated temperature applications, particularly for use in the die casting process but also useful in other applications, such as sand casting and permanent mould casting.

BACKGROUND OF THE INVENTION

The properties of structural metallic parts depend both on the composition of the alloy and on the fmal microstructure of the fabricated parts. The microstructure, in turn, depends both on the alloy system and on the conditions of its solidification. The interaction of alloy and process determines the microstructural features, such as type and morphology of precipitates, grain size, distribution and location of shrinkage microporosity, which greatly affect the properties of the structural parts. Thus, magnesium alloy parts produced by die casting exhibit very different properties from those produced by sand, permanent mould and other casting methods. It is the task of the alloys designer to interfere with the microstructure of the processed parts and try to optimize it in order to improve the final properties.

A comprehensive analysis of literature data and the inventors' experience show that there are few potential directions for developing cost-competitive Mg die castable alloys with improved creep properties.

The inexpensive die cast alloys having a Mg matrix and containing aluminum and up to 1% zinc (AZ alloys) or aluminum and magnesium without zinc (AM alloys) seem to offer the best combination of strength, castability ans corrosion resistance. They have however the handicaps of poor creep resistance and poor high temperature strength, especially in cast parts. The microstructure of these alloys is characterized by $Mg_{17}Al_{12}$ intermetallic precipitates (β-phase) in a matrix solid solution of Mg—Al—Zn. The intermetallic β-phase compound has a cubic crystal structure incoherent with the hexagonal close-packed structure of the matrix solid solution. Besides, it has a low melting point (462° C.) and can readily soften and coarsen with temperature due to accelerated difffusion, whereby it weakens the grain boundaries at elevated temperatures. It has been determined to be the key factor that accounts for the low creep resistance of these alloys. In die cast parts, the microstructure is further characterized by a very fine grain size and a massive grain boundary area available for easy creep deformation.

When developing Mg alloys for die casting applications, it should be taken into consideration that the presence of Al in the alloy is strictly required to provide good fluidity properties (castability). Hence, a magnesium alloy should contain a sufficient amount of Al in the liquid state prior to solidification. On the other hand, the presence of Al leads to the formation of eutectic $Mg_{17}Al_{12}$ intermetallic compounds—the aforesaid β-phase compound—which adversely affect creep resistance. Hence, it wouild be desirable to suppress its formation by the introduction into the alloy of a third element, generically indicated herein as "Me", that can form an $Al_zMe_w$, intermetallic compound with Al.

These considerations are illustrated by FIG. 1, showing a hypothetical ternary phase diagram for the Mg—Al—Me system (Me being the unspecified third alloying element). Let us assume that in this system can form in general, three intermetallic compounds: $Mg_{17}Al_{12}$, $Mg_xMe_y$, $Al_zMe_w$. In order to suppress the eutectic reaction involving the formation of the β-phase compound $Mg_{17}Al_{12}$, the element Me will have to react with aluminum to form the intermetallic compound $Al_2Me_w$. In this case the pseudobinary section Mg—$Al_zMe_w$ will be active. This will take place only in the case when the affinity of Me to Al is higher than that of Mg and the formation of $Al_zMe_w$ is preferential to the formation of the $Mg_xMe_y$ intermetallic compound.

The analysis of available binary phase diagrams Mg—Me and Al—Me have shown that only the following elements can comply with the requirements mentioned above:

rare earth elements (Ce, La, Nd, etc.)

alkaline earth elements(Ca, Ba, Sr)

3d—transition elements (Mn, Ti).

Calcium would seem to be the most attractive as the main additional alloying element, due to its low cost and to the presence of suitable master alloys with low melting points on the market. In addition, the low atomic weight of calcium compared with rare earth elements permits lower addition by weight in order to obtain the same volume percentage of the $Al_zMe_w$. strengthening phase.

The addition of Ca to Mg—Al—Mn and Mg—Al—Zn alloys is disclosed in some prior art patents. Thus, German Patent Specification No. 847,992 discloses magnesium based alloys which comprise 2 to 10 wt % aluminum, 0 to 4 wt % zinc, 0.001 to 0.5 wt % manganese, 0.5 to 3 wt % calcium and up to 0.005 wt % beryllium. A further necessary component in these alloys is 0.01 to 0.3 wt percent iron. PCT Patent Specification WO/CA96/25529also discloses a magnesium based alloy containing 2 to 6 wt % aluminum and 0.1 to 0.8 wt % calcium. The essential feature of that alloy is the presence of the intermetallic compound $Al_2Ca$ at the grain boundaries of the magnesium crystals. The alloy according to that invention may have a creep extension of less than 0.5% under an applied stress of 35 MPa at 150° C. during 200 hours.

British Patent Specification No. 2296256 describes a magnesium based alloy containing 1.5 to 10 wt % aluminum, less than 2 wt % rare earth elements, 0.25 to 5.5 wt % calcium. As optional components this alloy may also comprise 0.2 to 2.5 wt % copper and/or zinc.

Magnesium alloying with Zn are commonly used for solid solution strengthening of the matrix and decreasing the sensitivity of Mg alloys to corrosion due to heavy metal impurities. Alloying with Zn can provide the required fluidity and hence much lower Al levels may be used. Magnesium alloys containing up to 10% aluminum and less than about 2% Zn are die castable. However, a higher concentration of Zn leads to hot cracking and microporosity problems.

U.S. Pat. No. 3,892,565 discloses that at still higher Zn concentrations from 5 to 20%, the magnesium alloy again is easily die castable. As confirmation for this, U.S. Pat. No. 5,551,996 also describes a die castable magnesium alloy containing from 6 to 12% Zn and 6 to 12% Al. However, these alloys exhibit considerably less creep resistance than commercial AE42 alloy.

PCT patent application WO/KR97/40201 discloses a magnesium alloy for high pressure die casting, comprising 5.3 to 10 wt % Al, 0.7 to 6.0 wt % Zn, 0.5 to 5 wt % Si, and 0.15 to 10 wt % Ca. The authors claim that this alloy is die castable and exhibits high strength, toughness and elongation. However, this application is not concerned with creep resistance.

It is an object of this invention to provide magnesium alloys suitable for elevated temperature applications.

It is another object of this invention to provide alloys which are particularly well adapted for use in the die casting process.

It is a further object of this invention to provide alloys which may also be used for other applications such as sand casting and permanent mould casting.

It is a still further object of this invention to provide alloys which have high creep resistance and exhibit low creep deformation.

It is a still further object of this invention to provide alloys which have low susceptibility to hot tearing.

It is a still further object of this invention to provide alloys which have the aforesaid properties and have a relatively low cost.

Other objects and advantages of this invention will appear as the description proceeds.

SUMMARY OF THE INVENTION

The alloys of the present invention are magnesium based alloys for high pressure die casting, which comprise at least 83 wt % magnesium; 4.5 to 10 wt % aluminum; wt % zinc that is comprised in one ofthe two ranges 0.001 to 1 and 5 to 10; 0.15 to 1.0 wt % manganese; 0.05 to 1 wt % of rare earth elements; 0.01 to 0.2 wt % strontium; 0.0005 to 0.0015 wt % beryllium and calcium where calcium concentration depends on aluminum concentration and should be higher than 0.3 (wt % Al −4.0)$^{0.5}$ wt %, but lower than 1.2 wt %; any other elements being incidental impurities.

According to the present invention the alloys can have either 0.01 to 1 wt % zinc or 5 to 10 wt % zinc. In the latter case, the zinc content should be related to the aluminum content as follows:

$$\text{wt \% Zn}=8.2-2.2\ \ln(\text{wt \% Al}-3.5)$$

Microalloying by rare earth (RE) elements and strontium enables to modify the precipitated intermetallic compounds, increasing their stability. The strontium addition also causes reduced microporosity and an increasing soundness of castings.

It was found that in the case of a low zinc content, the microstructure consists of Mg—Al solid solution as a matrix and the following intermetallic compounds: $Al_2(Ca,Sr)$, $Mg_{17}(Al,Ca,Zn,Sr)_{12}$ and $Al_x(Mn,RE)_y$ wherein the "x" to "y" ratio depends on the aluminum content in the alloy. The above mentioned intermetallics are located in the grain boundaries of the magnesium matrix, strengthening them.

In the case of a high zinc content (5–10 wt %), the microstructure comprises Mg—Al—Zn solid solution as a matrix and the following intermetallic compounds: $Mg_{32}(Al,Zn,Ca,Sr)_{49}$, $Al_2(Ca,Zn,Sr)$ and $Al_x(Mn,RE)_y$ wherein the "x" to "y" ratio depends on the aluminum content in the alloy. These intermetallics are formed at the grain boundaries of the Mg—Al—Zn solid solution, increasing their stability.

The alloys of this invention are particularly useful for die casting applications due to decreased susceptibility to hot tearing and sticking to die. The alloys exhibit good creep resistance, high tensile yield strength at ambient temperature and may be easily cast without protective atmosphere.

The alloys also have a relative low cost and may be produced by any standard conventional process.

DETAILED DESCRIPTION OF PREFERRED EMBODIMENTS

Figure 1:
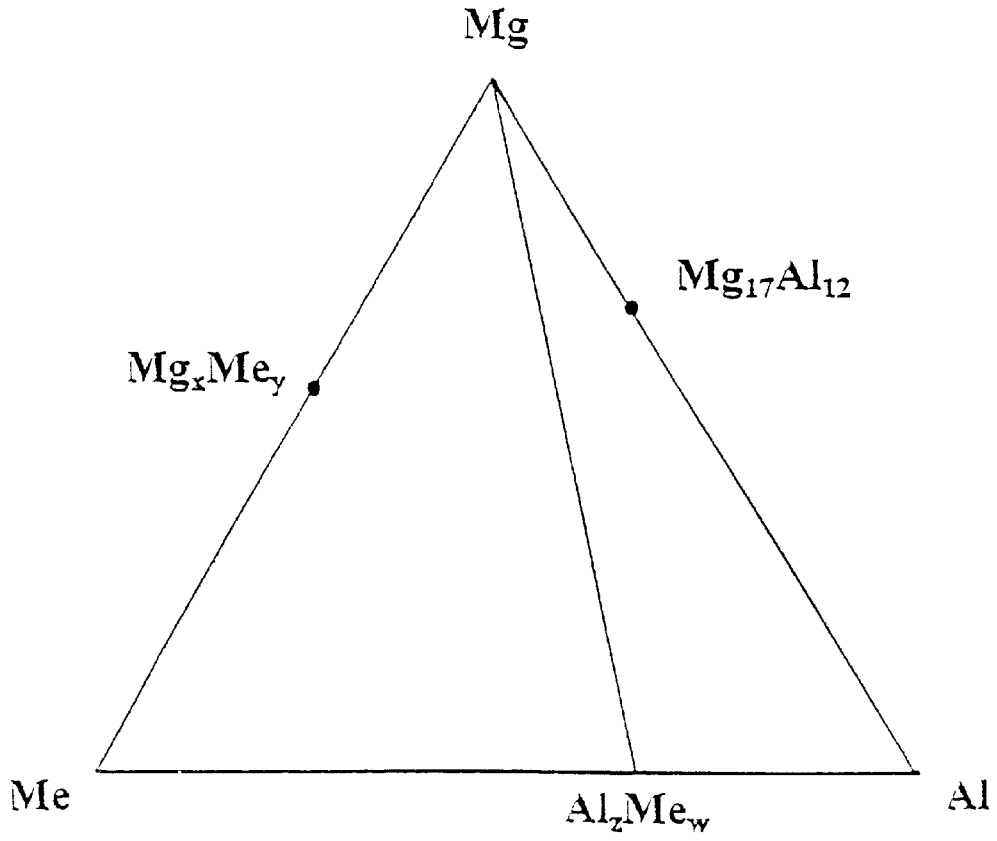
FIG. 1 shows a hypothetic ternary phase diagram Mg—Al—Me.
Figure 2:
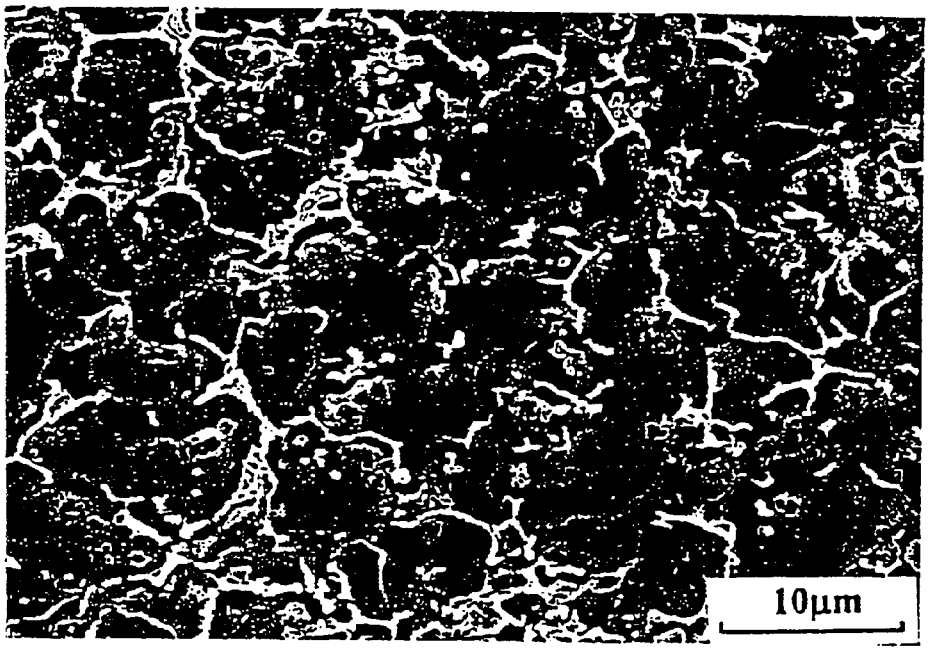
FIG. 2 shows the microstructure of a die cast alloy according to Example 3.
Figure 3:
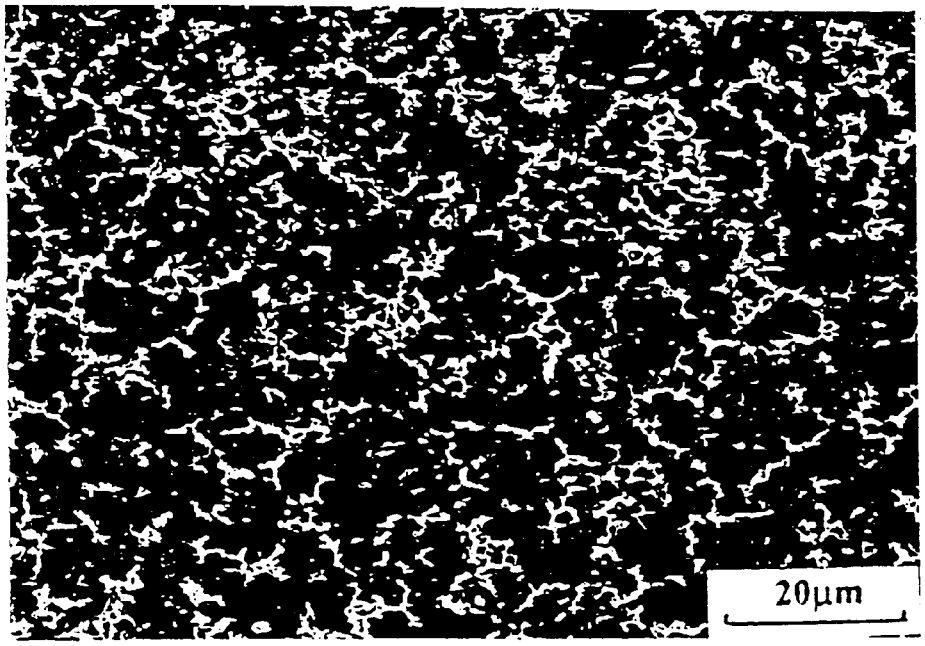
FIG. 3 shows the microstructure of a die cast alloy according to Example 4.
Figure 4:
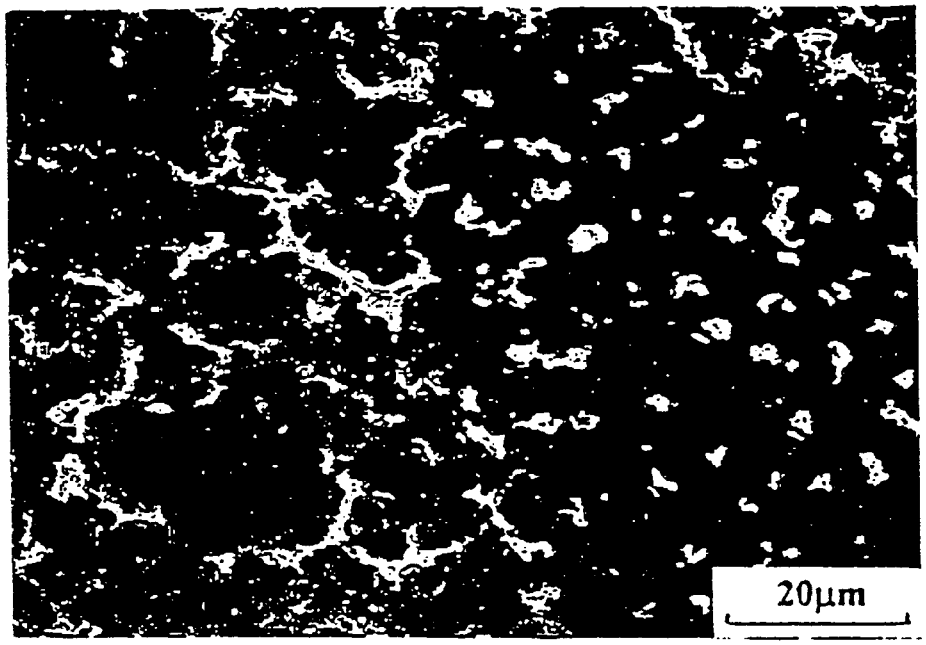
FIG. 4 shows the microstructure of a die cast AZ91 alloy.
Figure 5:
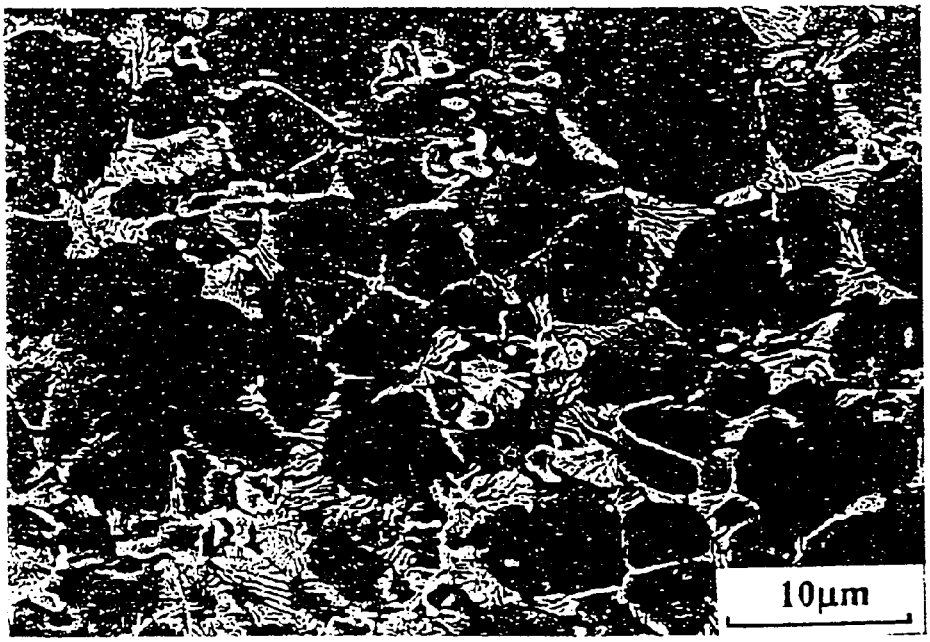
FIG. 5 shows the microstructure of a die cast AE42 alloy.

Magnesium based alloys which have compositions according to the invention, as specified hereinbefore, possess properties that are superior to those of the prior art alloys. These properties include good castability and corrosion resistance combined with reduced creep extension and high tensile yield strength.

As hereinbefore stated, the alloys of this invention comprise magnesium, aluminum, zinc, manganese, calcium, rare earth elements and strontium. As discussed below, they may also contain other elements as additives or impurities.

The magnesium based alloy of the invention comprises 4.5 to 10 wt % Al. If the alloy contains less than 4.5 wt % Al, it will not exhibit good fluidity properties and castability. If it contains more than 10 wt % Al, the aluminum tends to bind with the magnesium to form significant amounts of β-phase, $Mg_{17}(Al,Zn)_{12}$ intermetallics, causing embrittlement and decreasing creep resistance.

The preferred ranges for zinc are 0.5 to 1.0 weight percent, and 5 to 10 weight percent. Alloys which are prepared having zinc contents below the minimum amount specified above have decreased strength, castability and corrosion resistance. On the other hand, alloys containing more than 1 wt % zinc are susceptible to hot tearing and are not die castable. However, at still higher Zn concentrations, from 5 to 10%, the magnesium alloy again is easily die castable. It has been found that in order to provide the best combination of castability and mechanical properties at such high Zn concentrations, the zinc content should preferably be related to the aluminum content as follows: wt % Zn=8.2−2.2 ln (wt % Al −3.5). If the zinc concentration exceeds 10% the alloy becomes brittle.

The alloy also contains calcium. The presence of calcium benefits both creep resistance and oxidation resistance of proposed alloys. It has been found that in order to modify the β-phase or fully suppress its formation, the calcium content should be related to the aluminum content as follows: wt % Ca≧0.3 (wt % Al −4.0)$^{0.5}$.

On the other hand, the calcium content should be restricted to a maximum of 1.2 wt %, to avoid possible sticking of the castings in the die.

The alloys of this invention contain rare earth elements from 0.05 to 1 wt %. As used hereinafter, by the term "rare earth" is intended any element or mixture of elements with atomic numbers 57 to 71 (lanthanum to lutetium).

The cerium based mischmetal is preferable due to cost consideration. A preferred lower limit to the amount of rare earth metals is 0.15 wt %. A preferred upper limit is 0.4 wt %. The presence of rare earth elements is effective in increasing the stability of precipitated intermetallics and tends to improve corrosion resistance.

Furthermore, the alloys of the instant invention contain from 0.01 to 0.2 wt % strontium, more preferably from 0.05 to 0.15 wt % strontium may be added to alloys in order to modify the precipitated intermetallic phases and reduce microporosity.

The alloys of this invention also contain manganese in order to remove iron and improve corrosion resistance. The manganese content depends on the aluminum content and may vary from 0.15 to 1.0 wt %, preferably from 0.22 to 0.35 wt %.

The alloys of this invention also contain a minor amount of an element such as beryllium, no less than 0.0005 wt % and no more than 0.0015 wt %, and preferably around 0.001 wt %, to prevent oxidation of the melt.

Silicon is a typical impurity which is present in the magnesium that is used for magnesium alloy preparation. Therefore, silicon may be present in the alloy, but if it is, it should not exceed 0.05 wt %, preferably 0.03 wt %.

Iron, copper and nickel dramatically decrease the corrosion resistance of magnesium alloys. Hence, the alloys preferably contain less than 0.005 wt % iron and more preferably less than 0.004 wt % iron, preferably less than 0.003 wt % copper and preferably less than 0.002 wt % nickel and more preferably less than 0.001 wt % nickel.

It has been found that the addition of calcium, rare earth (RE) and strontium in the weight percentages set forth herein gives rise to precipitation of several intermetallic compounds.

In the alloys with a zinc content less than 1 wt % the $Al_2(Ca,Sr)$, $Mg_{17}(Al,Ca,Zn,Sr)_{12}$ and $Al_x(Mn,RE)_y$ intermetallics were detected at grain boundaries of the matrix—Mg—Al—Zn solid solutions. In the Al—Mn—RE intermetallic compounds the "x" to "y" ratio depends on the aluminum concentration in an alloy.

In the alloys having zinc contents from 5 to 10 wt % the microstructure consists of Mg—Al—Zn solid solution-matrix and the following intermetallics:

$Mg_{32}(Al,Zn,Ca,Sr)_{49}$, $Al_2(Ca,Zn,Sr)$ and $Al_x(M,RE)_y$ wherein the "x" to "y" ratio depends on the aluminum content in an alloy. These particles are located at the grain boundaries of the matrix.

The magnesium alloys of the present invention have good creep resistance combined with high tensile yield strength at ambient and elevated temperatures.

The magnesium alloys of this invention are intended for operation at the temperatures up to 150° C. and high load up to 100 MPa. At those conditions they exhibit a specific secondary creep rate (the ratio of a minimum creep rate $\dot{\epsilon}$ to ambient temperature yield strength $\sigma$) less than $1.10^{-10}s^{-1}MPa^{-1}$ under an applied stress of 85 MPa at 135° C., more preferably less than $7.\ 10^{-1}s^{-1}\ .MPa^{-1}$.

In addition the alloys of present invention have creep deformation $\epsilon_{1-2}$ corresponding transition from primary to secondary creep on the level of less than 0.8% under an applied stress of 85 MPa at 135° C., more preferably less than 0.65%.

The invention will be further described and illustrated in more detail by reference to the following examples.

EXAMPLES

General Procedure

Several alloys were prepared in a low carbon steel crucible under a $CO_2$+0.5% $SF_6$ protected atmosphere.

The following were the raw materials used:

Magnesium—Pure magnesium, grade 998OA, containing at least 99.8% Mg.

Manganese—An Al-60% Mn master alloy, which was introduced into the molten magnesium at a melt temperature from 700° C. to 720° C., depending on the manganese concentration. Special preparation of charged pieces and intensive stirring of the melt for 15–30 min were used to accelerate manganese dissolution.

Aluminum—Commercially pure Al (less than 0.2% impurities).

Zinc—Commercially pure Zn (less than 0.1% impurities).

Rare earth elements—An Al-20% MM master alloy, wherein MM means a cerium-based mishmetal containing 50% Ce+25% La+20% Nd+5% Pr.

Calcium—A master alloy Al-75% Ca

Strontium—A master alloy Al-10% Sr.

Typical alloy temperatures for Al, Zn, Ca, Sr and RE elements were from 690° C. to 710° C. Intensive stirring for 2–15 min was sufficient for dissolving these elements in the magnesium melt.

Beryllium—5–15 ppm of Beryllium were added, in the form of a master alloy Al-1% Be, after settling the melt at the temperatures 650° C.–670° C. prior to casting.

After obtaining the composition required the alloys were cast into the 8 kg ingots. The casting was performed without any protection of the metal during solidification in the mould. Neither burning nor oxidation were observed on the surface of the all experimental ingots.

The ring test was used in order to evaluate sucseptibility to hot tearing. The tests were carried out using a steel die with an inner tapered steel core (disk) having a variable The ring test was used in order to evaluate sucseptibility to hot tearing. The tests were carried out using a steel die with an inner tapered steel core (disk) having a variable diameter. The core diameter may vary from 30 mm to 100 mm with the step of 5 mm. The test samples have the shape of flat ring with the outer diameter of 110 mm and the thickness of 5 mm. Hence, the ring width is varied from 40 mm to 5 mm with the step of 2.5 mm.

The susceptibility to hot tearing is evaluated by the minimum width of the ring that can be cast without hot tear formation. The less this value the less susceptibility to hot tearing.

Die casting trials were performed using a 200 ton cold chamber die casting machine. The die used to produce test samples was a three cavity mould containing:

One round tensile test specimen according to ASTM Standard B557M -94.

One ASTM E23 standard impact test sample.

One sample suitable for creep testing.

The castability was also evaluated during die casting. A rating of 1 to 5 ('1" representing the best and "5"' representing the worst) was given to each casting based on the observed fluidity, oxidation resistance and die-sticking.

Chemical analysis was conducted using spark emission spectrometer.

Microstructural analyses were performed using optical microscope and scanning electron microscope (SEM) equipped with energy dispersive spectrometer (EDS). The phase composition was determined using X-Ray diffraction analysis.

The average value of porosity was quantified by actual density measurements. The Archemedian principle was applied for determi g the actual density. The density value obtained was converted into percent porosity by using the equation given below:

$$\% \text{ Porosity}=[(d_{theor}-d_{act})/d_{theor}].100$$

where $d_{theor}$—theoretical density; $d_{act}$—actual density.

Tensile testing at ambient temperature was performed using an Instron 4483 machine. Tensile Yield Strength (TYS), Ultimate Tensile Strength (UTS) and Percent Elongation (%E) were determined.

The Charpy impact tests were conducted using the ASTM E 23 standard unnoched impact test samples.

The alloys of instant invention are well tailored for applications in automobille power component such as gear box housing. This component operates at a temperature of about 135° C. and a high load of 85 MPa. Hence, alloy for this application should comply with following requirements: very low primary creep rate, moderate secondary creep rate and rather high yield strength at operating temperatures. The SATEC Model M-3 machine was used for creep testing. Based on the above mentioned creep tests were performed at 135° C. for 200 hrs under a load of 85 MPa.

The specific secondary creep rate (the ratio of a secondary creep rate $\dot{\epsilon}$ to ambient temperature yield strength $\sigma_y$) and the creep deformation $\epsilon_{1-2}$ corresponding transition from primary to secondary creep were considered and selected as representative parameters taaing into account both creep resistance and strength of newly developed alloys.

EXAMPLES 1–5 AND COMPARATIVE EXAMPLES 1–4

Five examples of alloys according to the invention and four comparative examples are illustrated in Tables 1 to 4. The chemical compositions of newly developed alloys are given in Table 1 along with the chemical compositions of compared alloys. It should be pointed out that the Comparative Examples 3 and 4 are the commercial magnesium based alloys AZ91D and AE42 respectively.

The results of metallography investigation of new alloys are given in FIGS. 2–5. These micrographs demonstrate that the precipitated particles of intermetallic compounds are located along the grain boundaries of the magnesium matrix. Table 2 summarizes the phase composition of the alloys of the instant invention and the comparative alloys.

It is evident that alloying aluminlum, zinc, calcium, rare earth and strontium in the weight percentages set forth herein results in formation of new intermetallic phases, which are different from the intermetallic compounds that are present in AZ91D and AE42 alloys.

The results of castability tests and mechanical properties of alloys of instant invention and comparative alloys are listed in Table 3 and Table 4. It can be seen that alloys of the instant invention exhibit castability properties comparable to alloy AZ91D (comparative example 3) which is generally accepted as the "best diecastable" magnesium alloy.

On the other hand, the alloys of the instant invention exhibit reduced porosity, similar or better yield strength and specific yield strength $\sigma_y/\rho$ compared to AZ91D alloy and, particularly, AE42 alloy.

However, the greatest advantage of the alloys of the instant invention was revealed during the conduction of the creep test. Table 4 shows that new alloys exhibit the specific secondary creep rate $\dot{\epsilon}/\sigma_y$ in several time less than AZ91D alloy and significantly less than AE42 alloy.

In addition, the creep deformation $\epsilon_{1-2}$ corresponding transition from primary to secondary creep was considerably less for the alloys of the instant invention compared to comparative examples.

TABLE 1

Chemical Compositions of Alloys

| Alloy | Al % | Zn % | Mn % | Ca % | RE % | Sr % | Si % | Be % | Fe % | Cu % | Ni % |
|---|---|---|---|---|---|---|---|---|---|---|---|
| Example 1 | 6.0 | 0.89 | 0.37 | 0.45 | 0.12 | 0.11 | 0.01 | 0.0008 | 0.001 | 0.0005 | 0.0006 |
| Example 2 | 7.0 | 0.81 | 0.31 | 0.81 | 0.15 | 0.07 | 0.01 | 0.0008 | 0.001 | 0.0006 | 0.0007 |
| Example 3 | 6.9 | 0.83 | 0.32 | 1.08 | 0.13 | 0.12 | 0.01 | 0.0007 | 0.002 | 0.0005 | 0.0008 |
| Example 4 | 8.9 | 0.73 | 0.26 | 0.98 | 0.15 | 0.09 | 0.01 | 0.0009 | 0.002 | 0.0006 | 0.0008 |
| Example 5 | 8.8 | 0.77 | 0.is | 0.75 | 0.92 | 0.03 | 0.01 | 0.0011 | 0.002 | 0.0006 | 0.0009 |
| Comparative Example 1 | 4.4 | 0.03 | 0.32 | 1.35 | — | — | 0.01 | 0.0008 | 0.002 | 0.0005 | 0.0007 |
| Comparative Example 2 | 8.9 | 0.74 | 0.25 | 0.62 | — | — | 0.01 | 0.0007 | 0.003 | 0.0007 | 0.0007 |
| Comparative Example 3 | 9.1 | 0.73 | 0.24 | — | — | — | 0.01 | 0.0008 | 0.003 | 0.0006 | 0.0006 |
| Comparative Example 4 | 4.1 | 0.007 | 0.22 | — | 2.62 | — | 0.01 | 0.0007 | 0.002 | 0.0005 | 0.0008 |

TABLE 2

Phase Compositions of Alloys

| Alloy | Phase Composition | | |
|---|---|---|---|
| Example 1 | Mg—$Al_{SS}$, $Al_{0.58}Mn_{0.40}RE_{0.02}$ | $Mg_{17}(Al,Ca,Zn,Sr)_{12}$, | $Al_2(Ca,Zn,Sr)$, |
| Example 2 | Mg—$Al_{SS}$, $Al_8(Mn,RE)_5$ | $Mg_{17}(Al,Ca,Zn,Sr)_{12}$, | $Al_2(Ca,Sr)$, |
| Example 3 | Mg—$Al_{SS}$, $Al_8(Mn,RE)_5$, | $Mg_{17}(Al,Ca,Zn,Sr)_{12}$, $Al_{0.58}Mn_{0.40}RE_{0.02}$ | $Al_2(Ca,Sr)$, |

TABLE 2-continued

Phase Compositions of Alloys

| Alloy | Phase Composition | | |
|---|---|---|---|
| Example 4 | Mg—$Al_{SS}$, $Al_{0.64}Mn_{0.29}RE_{0.07}$ | $Mg_{17}(Al,Ca,Zn)_{12}$, | $Al_2(Ca,Sr)$, |
| Example 5 | Mg—$Al_{SS}$, $(Al,Zn)_{11}(Ca,RE)_3$ | $Mg_{17}(Al,Ca,Zn)_{12}$, $(Al,Zn)_{11}(Ca,RE)_3$ | $Al_{0.64}Mn_{0.22}RE_{0.12}$, |
| Comparative Example 1 | Mg—$Al_{SS}$, | $Al_2Ca$, | $Al_{0.52}Mn_{0.48}$ |
| Comparative Example 2 | Mg—$Al_{SS}$, | $Mg_{17}(Al,Ca,Zn)_{12}$, | $Al_8Mn_5$ |
| Comparative Example 3 | Mg—$Al_{SS}$, | $Mg_{17}(Al,Zn)_{12}$, | $Al_8Mn_5$ |
| Comparative Example 4 | Mg—$Al_{SS}$, | $Al_{11}RE_3$, | $Al_{10}RE_2Mn_7$ |

TABLE 3

Castability Properties

| Alloy | Ring width mm | Die castability: Fluidity | Oxidation resistance | Sticking to die |
|---|---|---|---|---|
| Example 1 | 17.5 | 2 | 2 | 2 |
| Example 2 | 15 | 1 | 1 | 1 |
| Example 3 | 15 | 1 | 1 | 1 |
| Example 4 | 12.5 | 1 | 1 | 2 |
| Example 5 | 12.5 | 1 | 1 | 2 |
| Comparative Example 1 | 20 | 3 | 1 | 5 |
| Comparative Example 2 | 12.5 | 1 | 1 | 2 |
| Comparative Example 3 | 12.5 | 1 | 2 | 1 |
| Comparative Example 4 | 25 | 3 | 3 | 2 |

were also prepared and examined by the general procedure hereinbefore described.

The chemical compositions of the said alloys are listed in Table 5.

Figure 6:
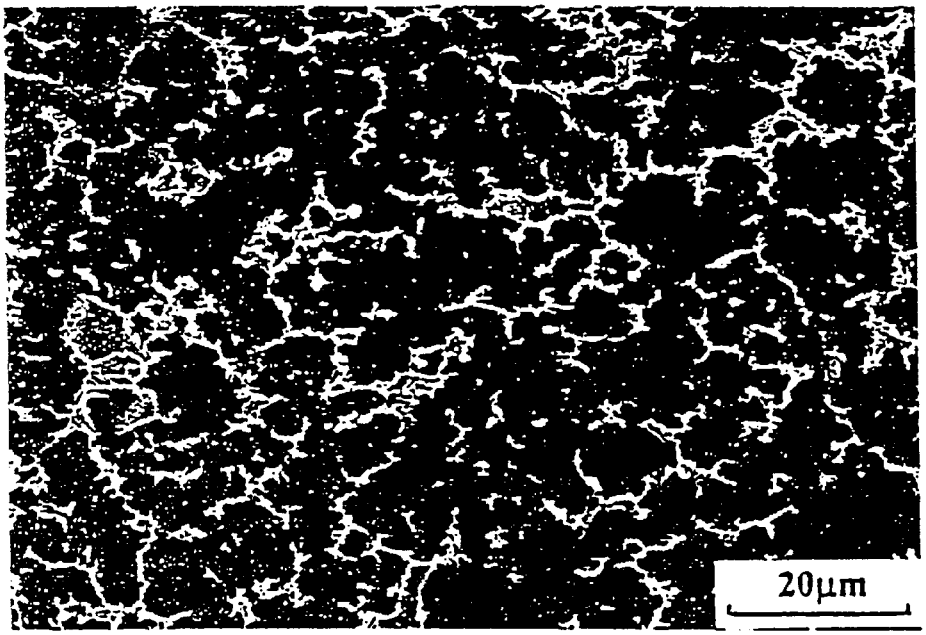
FIG. 6 shows the microstructure of a die cast alloy according to Example 6.
Figure 7:
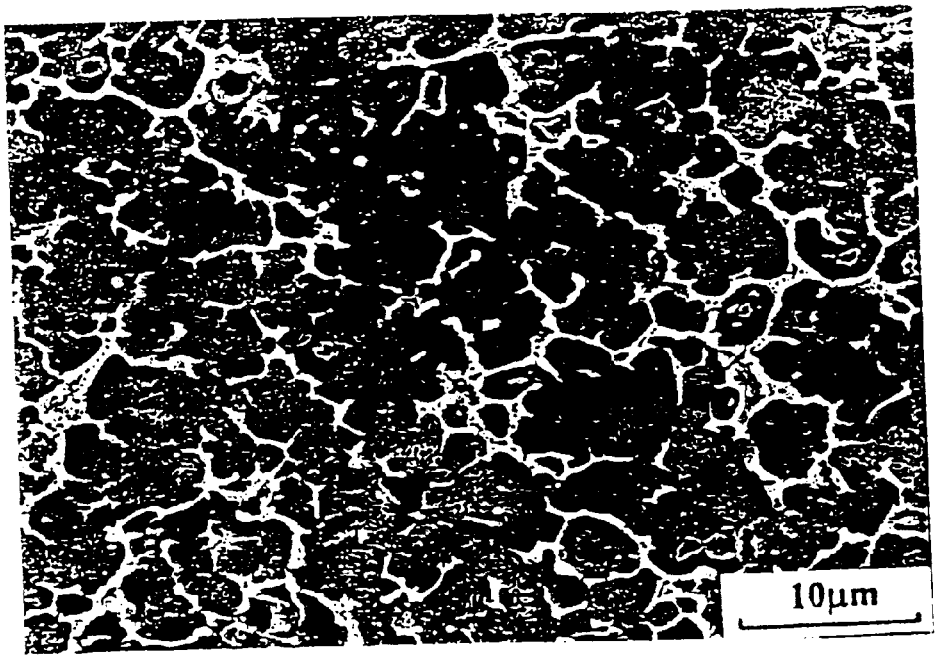
FIG. 7 shows the microstructure of a die cast alloy according to Example 8.

The results of metallography examination are shown in FIGS. 6 and 7. These results coupled with data of EDS analyses and X-ray difraction indicate that new phases are present in the alloys of the instant invention. As can be seen from Table 6, which lists the phase compositions of said alloys, the intermetallic compounds which are precipitated in the alloys according to the invention are completely different from the intermetallics which are formed in AZ91D alloy and AE42 alloy (Comparative Examples 3 and 4).

Table 7 demonstrates that the alloys of the instant invention possess castability properties similar to or better than those of AZ91D alloy, and significantly superior to castability properties of AE42 alloy and alloy of comparative Example 5.

The new alloys exhibit also reduced porosity, higher specific yield strength $\sigma_y/\rho$ than those properties of AZ91D alloy and AE42 alloy and alloys of comparative Examples 5 and 6.

TABLE 4

Mechanical Properties and Creep Resistance

| Alloy | TYS, MPa | UTS MPa | E % | Impact Strength J | ρ g/cm³ | % porosity | $\sigma_y/\rho$ MPa · cm³ g | $\epsilon/\sigma_y \cdot 10^{11}$ $s^{-1}MPa^{-1}$ | $\epsilon_{1-2}$, % |
|---|---|---|---|---|---|---|---|---|---|
| Example 1 | 139 | 233 | 11.7 | 9.4 | 1.76 | 1.9 | 78.3 | 7.9 | 0.79 |
| Example 2 | 143 | 215 | 7.2 | 5.6 | 1.76 | 1.9 | 81.7 | 6.4 | 0.77 |
| Example 3 | 155 | 210 | 6.0 | 5.2 | 1.77 | 1.7 | 864 | 5.1 | 0.75 |
| Example 4 | 167 | 223 | 4.9 | 4.9 | 1.78 | 1.6 | 93.9 | 9.2 | 0.76 |
| Example 5 | 167 | 220 | 4.6 | 4.6 | 1.80 | 1.7 | 92.8 | 7.1 | 0.78 |
| Comparative Example 1 | 135 | 190 | 4.7 | 6.1 | 1.74 | 2.1 | 77.6 | 10.9 | 1.58 |
| Comparative Example 2 | 158 | 210 | 4.2 | 4.9 | 1.77 | 2.3 | 89.2 | 14.5 | 0.82 |
| Comparative Example 3 | 155 | 220 | 4.0 | 4.5 | 1.75 | 3.3 | 88.6 | 29.5 | 0.85 |
| Comparative Example 4 | 122 | 215 | 10.0 | 13.2 | 1.76 | 1.8 | 69.3 | 10.2 | 0.82 |

EXAMPLES 6–9 AND COMPARATIVE EXAMPLES 3–6

Four additional alloys according to the invention were prepared and examined by the general procedure hereinbefore described, and constitute Examples 6 to 9. Previously described Comparative Examples 3 and 4 were used for comparison with Examples 6 to 9, and two other comparative alloys, constituting Comparative Examples 5 and 6, As can be seen from Table 8 the alloys of the instant invention exhibit specific secondary creep rate $\dot{\epsilon}/\sigma_y$ which is one order of magnitude less than that of alloy AZ91D and is less than half of specific secondary creep rate for AE42 alloy and alloys of comparative Examples 5 and 6 after testing at 135° C. under a load of 85 MPa.

In addition, the alloys of the instant invention exhibit the creep deformation $\epsilon 1-2$ considerably less than that in alloys of comparative examples 5 and 6.

TABLE 5

Chemical Compositions of alloys

| Alloy | Al % | Zn % | Mn % | Ca % | RE % | Sr % | Si % | Be % | Fe % | Cu % | Ni % |
|---|---|---|---|---|---|---|---|---|---|---|---|
| Example 6 | 6.1 | 6.1 | 0.28 | 0.61 | 0.17 | 0.13 | 0.01 | 0.0007 | 0.002 | 0.0006 | 0.0007 |
| Example 7 | 5.4 | 6.8 | 0.34 | 0.78 | 0.13 | 0.07 | 0.01 | 0.0006 | 0.003 | 0.0004 | 0.0007 |
| Example 8 | 5.0 | 7.3 | 0.27 | 0.67 | 0.16 | 0.08 | 0.01 | 0.008 | 0.003 | 0.0005 | 0.0007 |
| Example 9 | 5.5 | 6.7 | 0.29 | 0.85 | 0.92 | 0.07 | 0.01 | 0.0008 | 0.003 | 0.0005 | 0.0008 |
| Comparative Example 3 | 9.1 | 0.73 | 0.24 | — | — | — | 0.91 | 0.0008 | 0.003 | 0.0006 | 0.0066 |
| Comparative Example 4 | 4.1 | 0.07 | 0.22 | — | 2.62 | — | 0.01 | 0.0007 | 0.002 | 0.0006 | 0.0006 |
| Comparative Example 5 | 4.2 | 7.1 | 0.29 | 1.45 | 0.35 | — | 0.01 | 0.0007 | 0.002 | 0.0007 | 0.0007 |
| Comparative Example 6 | 8.4 | 7.5 | 0.24 | 0.48 | — | 0.09 | 0.01 | 0.0006 | 0.003 | 0.0006 | 0.0008 |

TABLE 6

Phase Compositions of Alloys

| Alloy | Phase Composition | | | |
|---|---|---|---|---|
| Example 6 | Mg—Al—$Zn_{SS}$, | $Mg_{32}(Al, Zn, Ca, Sr)_{49}$, | $Al_2(Ca,Zn)$, | $Al_{0.55}Mn_{0.42}RE_{0.03}$ |
| Example 7 | Mg—Al—$Zn_{SS}$, | $Mg_{32}(Al, Zn, Ca, Sr)_{49}$, | $Al_2(Ca, Zn)$, | $Al_{0.54}Mn_{0.43}RE_{0.03}$ |
| Example 8 | Mg—Al—$Zn_{SS}$, | $Mg_{32}(Al, Zn, Ca, Sr)_{49}$, | $Al_2(Ca, Zn)$, | $Al_{0.51}Mn_{0.47}RE_{0.02}$ |
| Example 9 | Mg—Al—$Zn_{SS}$, | $Mg_{32}(Al, Zn, Ca, Sr)_{49}$, | $(Al,Zn)_{11}(RE, Ca)_3$, | $Al_{0.55}Mn_{0.29}RE_{0.16}$ |
| Comparative Example 3 | Mg—$Al_{SS}$, | $Mg_{17}(Al, Zn)_{12}$, | $Al_8Mn_5$ | |
| Comparative Example 4 | Mg—$Al_{SS}$, | $Al_{11}RE_3$, | $Al_{10}RE_2Mn_7$ | |
| Comparative Example 5 | Mg—Al—$Zn_{SS}$, | $Mg_{32}(Al, Zn, Ca)_{49}$, | $Al_{0.54}Mn_{0.26}RE_{0.20}$ | |
| Comparative Example 6 | Mg—Al—$Zn_{SS}$, | $Mg_{32}(Al, Zn, Ca, Sr)_{49}$, | $Al_{0.55}Mn_{0.45}$ | |

TABLE 7

Castability Properties

| Alloy | Ring width mm | Die castability: Fluidity | Die castability: Oxidation resistance | Die castability: Sticking to die |
|---|---|---|---|---|
| Example 6 | 12.5 | 1 | 1 | 1 |
| Example 7 | 12.5 | 1 | 1 | 1 |
| Example 8 | 10 | 1 | 1 | 1 |
| Example 9 | 12.5 | 1 | 1 | 2 |

TABLE 7-continued

Castability Properties

| Alloy | Ring width mm | Die castability: Fluidity | Die castability: Oxidation resistance | Die castability: Sticking to die |
|---|---|---|---|---|
| Comparative Example 3 | 12.5 | 1 | 2 | 1 |
| Comparative Example 4 | 25 | 3 | 3 | 2 |
| Comparative Example 5 | 30 | 1 | 1 | 4 |
| Comparative Example 6 | 20 | 1 | 1 | 1 |

TABLE 8

Mechanical Properties and Creep Resistance

| Alloy | TYS, MPa | UTS MPa | E % | Impact Strength J | ρ g/cm³ | % porosity | $\sigma_\gamma/\rho$ MPa · cm³ g | $\epsilon/\sigma_\gamma \cdot 10^{11}$ $s^{-1}MPa^{-1}$ | $\epsilon_{1-2}$, % |
|---|---|---|---|---|---|---|---|---|---|
| Example 6 | 164 | 227 | 4.4 | 3.5 | 1.83 | 1.6 | 90.2 | 4.4 | 0.65 |
| Example 7 | 174 | 218 | 4.4 | 3.0 | 1.88 | 1.5 | 92.0 | 2.7 | 0.65 |
| Example 8 | 178 | 215 | 4.0 | 2.8 | 1.90 | 1.6 | 93.7 | 2.7 | 0.65 |
| Example 9 | 176 | 220 | 4.7 | 3.6 | 1.88 | 1.7 | 92.0 | 2.5 | 0.63 |
| Comparative Example 3 | 155 | 220 | 4.0 | 4.5 | 1.75 | 3.3 | 88.6 | 29.5 | 0.85 |

TABLE 8-continued

Mechanical Properties and Creep Resistance

| Alloy | TYS, MPa | UTS MPa | E % | Impact Strength J | ρ g/cm³ | % porosity | $\sigma_\gamma/\rho$ MPa · cm³ g | $\epsilon/\sigma_\gamma \cdot 10^{11}$ $s^{-1}MPa^{-1}$ | $\epsilon_{1-2}$, % |
|---|---|---|---|---|---|---|---|---|---|
| Comparative Example 4 | 122 | 215 | 10.0 | 13.2 | 1.76 | 1.8 | 69.3 | 10.2 | 0.82 |
| Comparative Example 5 | 152 | 210 | 2.6 | 1.7 | 1.83 | 3.7 | 84.7 | 10.1 | 0.89 |
| Comparative Example 6 | 176 | 215 | 1.8 | 1.9 | 1.87 | 4.8 | 94.1 | 11.2 | 0.87 |

While a number of examples of the invention have been described for illustrative purposes, it will be understood that they do not constitute a limitation and that the invention may be carried out by skilled persons with many variations, modifications and adaptations without departing from its spirit or exceeding the scope of the claims.

What is claimed is:

1. A magnesium based alloy, comprising:

at least 83 wt % of magnesium;

from 4.5 to 10 wt % of Al;

a wt % of Zn that is comprised in one of the two ranges 0.01 to 1 and 5 to 10;

from 0.15 to 1.0wt % of Mn;

from 0.05 to 1 wt % of rare earth elements;

from 0.01 to 0.2 wt % of Sr;

from 0.0005 to 0.0015 wt % Be; and calcium in an amount higher than 0.35 (wt % Al −4.0)$^{0.5}$ wt % and lower than 1.2 wt %.

2. An alloy according to claim 1, further comprising incidental impurities.

3. An alloy according to claim 1, which contains at least 88 wt % magnesium, 4.5 to 10 wt % Al, 0.1 to 1 wt % of rare earth elements.

4. An alloy according to claim 1, which contains 5 to 10 wt % Zn and 0.1 to 1 wt % of rare earth elements, and wherein the zinc content is related to the aluminum content by the formula $$\text{wt \% Zn}=8.2-2.2\ln(\text{wt \% Al}-3.5).$$

5. An alloy according to claim 4, which contains at least 85 wt % of magnesium.

6. An alloy according to claim 1, which contains 0.00 to 0.005 wt % iron, 0.00 to 0.003 wt % copper, 0.00 to 0.002 wt % nickel,and 0.00 to 0.05 wt % silicon.

7. An alloy according to claim 3, comprising an Mg—Al solid solution as a matrix, and intermetallic compounds $Al_2$(Ca, Sr); $Mg_{17}$(Al, Ca, Zn)$_{12}$ and $Al_x$(Mn, RE)$_y$, wherein the "x" to "y" ratio depends on Al content of the alloy, the said intermetallics being located at grain boundaries of the Mg—Al solid solution matrix.

8. An alloy according to claim 4, containing an Mg—Al—Zn solid solution as a matrix and intermetailic compounds $Mg_{32}$(Al,Zn,Ca,Sr)$_{49}Al_2$(Ca, Zn, Sr) and $Al_x$(Mn,RE)$_y$ wherein the "x" to "y" ratio depends on the Al content of the alloy, the said intermetallics being located at grain boundaries of the Mg—Al—Zn solid solution matrix.

9. A cast alloy according to any one of claims 1 to 8, which has a creep resistance such that the ratio of the secondary creep rate : to the room temperature yield strength is less than $1.10^{-10}s^{-1}.MPa^{-1}$ under an applied stress of 85 MPa at 135° C.

10. A cast alloy according to any one of claims 1 to 8, which has a creep deformation $\epsilon_{1-2}$ that corresponds to transition from primary to secondary creep of less than 0.8% under an applied stress of 85 MPa at 135° C.

11. An alloy according to any one of claims 1 to 8, having susceptibility to hot tearing low enough to permit that it can be permanent mould cast into rings with outer diameter of 110 mm and thickness of less than 20 mm without hot tear formation.

12. A method of using an alloy according to claim 1 comprising casting said alloy.

13. A method of using an alloy according to claim 1 comprising high pressure die casting said alloy.

* * * * *